US010906699B2

(12) United States Patent
Banet et al.

(10) Patent No.: US 10,906,699 B2
(45) **Date of Patent: *Feb. 2, 2021**

(54) NON-METALLIC TIE

(71) Applicants: Craig Banet, Bryn Mawr, PA (US); Jeffrey Jacob Cernohous, Hudson, WI (US); Paul E. Humpal, Stillwater, MN (US); Phillip Brunner, Hudson, WI (US)

(72) Inventors: Craig Banet, Bryn Mawr, PA (US); Jeffrey Jacob Cernohous, Hudson, WI (US); Paul E. Humpal, Stillwater, MN (US); Phillip Brunner, Hudson, WI (US)

(73) Assignee: Banemer, LLC, Lansdale, PA (US)

( * ) Notice: Subject to any disclaimer, the term of this patent is extended or adjusted under 35 U.S.C. 154(b) by 157 days.

This patent is subject to a terminal disclaimer.

(21) Appl. No.: 16/107,026

(22) Filed: Aug. 21, 2018

(65) Prior Publication Data

US 2019/0062005 A1 Feb. 28, 2019

Related U.S. Application Data

(60) Provisional application No. 62/549,729, filed on Aug. 24, 2017.

(51) Int. Cl.

| | |
|---|---|
| ***B65D 33/16*** | (2006.01) |
| ***B65D 33/30*** | (2006.01) |
| ***A41D 13/11*** | (2006.01) |
| *C08L 67/04* | (2006.01) |
| *C08L 45/00* | (2006.01) |

(52) U.S. Cl.

CPC ..... *B65D 33/1616* (2013.01); *A41D 13/1161* (2013.01); *B65D 33/1658* (2013.01); *B65D 33/30* (2013.01)

(58) Field of Classification Search

None

See application file for complete search history.

(56) References Cited

U.S. PATENT DOCUMENTS

| | | | | |
|---|---|---|---|---|
| 3,985,703 | A | 10/1976 | Ferry et al. | |
| 4,965,135 | A | 10/1990 | Im et al. | |
| 5,128,183 | A | 7/1992 | Buzio | |
| 5,154,964 | A | 10/1992 | Iwai et al. | |
| 5,238,631 | A | 8/1993 | Stolk et al. | |
| 5,494,969 | A | 2/1996 | Abe et al. | |
| 5,607,748 | A | 3/1997 | Feltman | |
| 5,760,118 | A * | 6/1998 | Sinclair | A61L 15/26 524/306 |
| 5,827,461 | A | 10/1998 | Feltman | |
| 5,989,683 | A | 11/1999 | Haddock et al. | |
| 6,663,809 | B1 | 12/2003 | Haddock et al. | |
| 6,673,413 | B1 | 1/2004 | Kincel et al. | |
| 7,011,879 | B1 | 3/2006 | Contreras et al. | |
| 7,363,686 | B2 | 4/2008 | Fukuyasu et al. | |
| 8,816,008 | B2 | 8/2014 | Pirri et al. | |
| 9,452,593 | B2 | 9/2016 | Tatarka et al. | |
| 2005/0154114 | A1 | 7/2005 | Hale | |
| 2012/0021151 | A1 | 1/2012 | Tatarka et al. | |
| 2014/0066564 | A1 | 3/2014 | Kaushik et al. | |
| 2015/0291791 | A1 | 10/2015 | Makal et al. | |
| 2019/0062548 | A1 * | 2/2019 | Banet | C08L 67/02 |

FOREIGN PATENT DOCUMENTS

| | | | |
|---|---|---|---|
| CN | 103102659 | * | 5/2013 |
| JP | 2002037995 | * | 2/2002 |
| WO | WO-2011157691 | A1 | 12/2011 |
| WO | WO-2012038441 | A1 | 3/2012 |

OTHER PUBLICATIONS

Guo Jun, J.C., "Investigation of Electron Beam Irradiated Acrylonitrile-Butadiene-Styrene (ABS) Under Oven Treatment", Faculty of Engineering and Science, Universiti Tunku Abdul Rahman, 2015, pp. 1-108.

International Search Report and Written Opinion for International Application No. PCT/US2018/047498, dated Oct. 11, 2018.

Kraton, "Kraton Polymers for Oil Modification Versatile Solutions for Synthetic and Natural Based Oils", 2016, pp. 1-8.

* cited by examiner

*Primary Examiner* — David J Buttner

(74) *Attorney, Agent, or Firm* — Faegre Drinker Biddle & Reath LLP

(57) ABSTRACT

A non-metallic tie, for example a twist-tie or a tin-tie, comprises a polymeric material melt-blending from a composition containing (a) from about 50 to about 80 wt % of at least one matrix-forming thermoplastic polymer which is amorphous or becomes amorphous when melted, and (b) from about 20 to about 50 wt % of at least one elastomeric polymer which has a flexural modulus of less than 700 MPa and a glass transition temperature less than 25° C., based on the combined weight of (a) and (b). The tie is characterized by tensile elongation at break according to ASTM D638-00 of from about 20° to about 100°; and a dead fold angle equal to or less than about 30°, as determined by a method including the steps of (i) providing a sample of the twist tie having two end portions, a thickness of 1-2 mm and a length of about 100 mm; (ii) folding the sample approximately in half in the lengthwise direction so that end portions are approximately adjacent to each other; (iii) relaxing the folded sample at room temperature for three minutes; and (iv) measuring as the dead fold angle the included angle between the article sample end portions.

21 Claims, 1 Drawing Sheet

NON-METALLIC TIE

RELATED APPLICATIONS

This application claims benefit to U.S. Provisional Application Ser. No. 62/549,729 filed Aug. 24, 2017 which is incorporated by reference in its entirety for all useful purposes.

FIELD OF THE INVENTION

The present invention relates to polymeric, non-metallic ties for closing bags and other packaging, for gathering or securing articles of clothing, and for other uses.

BACKGROUND OF THE INVENTION

Ties such as twist-ties or tin-ties generally comprise one or more pieces of malleable, magnetic metal, such as a wire or ribbon, with the length of the metal covered by paper or plastic. Ties typically comprise a metal wire encased in a thin strip of paper or plastic. A twist tie is used by wrapping it around the item to be fastened, then twisting the ends together. Ties are used by consumers to close or reclose flexible bags. Sometimes the ties are provided separately to be later attached to the packaging by the consumer, as in the case of a twist-tie. At other times, the ties are attached to packaging, such as a bag of coffee, by the manufacturer or packager of the product, as in the case of a tin-tie.

Polymeric materials and composites are not typically conformable. That is, they do not hold their shape after they have been deformed. Metals on the other hand, can be deformed into a shape and will hold that shape. Metals, when deformed, can rearrange their crystalline structure on the molecular level and hold their shape as a result. Thus, conventional twist-ties and tin-ties are formed with a wire core enclosed in either a plastic or a paper ribbon. Metal core twist-ties and tin-ties suffer from certain disadvantages. The metal core can protrude from the covering and cause injury. Metals can rust when exposed to moisture. Most importantly, metal closures are inappropriate for sealing containers for food and other materials that must be irradiated or heated, such as in microwave ovens, or which must be passed through metal detectors for post-packaging inspection.

Polymers have a very different molecular structure from metals. Polymers are typically very long and entangled molecules made of many repeat units. Because of this entangled molecular structure, they possess significant viscoelastic behavior. Specifically, when polymers are deformed below their glass transition temperature or melting temperatures, they will recover to their initial shape. This "memory" feature is a result of polymer entanglement, which is important for polymers mechanical properties. However, it is difficult to design polymeric systems that are rigid, conformable, and have good mechanical properties. A material with such properties would have significant commercial utility.

Feltman (U.S. Pat. No. 5,607,748), Haddock et al. (U.S. Pat. Nos. 5,989,683 and 6,663,809) describe various polymeric twist-tie articles that include a wing and core structure derived from rigid compositions. However, these compositions lack the toughness required for twist tie applications. Also, they do not hold shape without the core-wing design. Other core-wing twist ties are described by Kincel et al. (U.S. Pat. No. 6,673,413) and Contreras et al. (U.S. Pat. No. 7,011,879). The Kincel et al. twist-tie is a composite article formed by a flat elongated ribbon like thermoplastic substrate having a thermoplastic monofilament disposed therein. The Contreras et al. twist-tie is a composite structure formed by a multistep process consisting of a thermoplastic monofilament having an oriented characteristic produced by stretching a pre-heated monofilament through a heated, volume reducing die followed by coating of the monofilament with an extrusion of thermoplastic enclosing the monofilament while simultaneously forming a pair of opposed wings integral with the coating.

Iwai et al. (U.S. Pat. No. 5,154,964) and Fukuyasu et al. (U.S. Pat. No. 7,363,686) describe twist ties based on various crystalline polyolefin compositions that require either a core-wing design or a crystalline core-less composition. The Iwai et al. twist-ties are formed of crystalline thermoplastic resins and optionally, fine glass beads. They are characterized by a core-wing structure. Stolk et al. (U.S. Pat. No. 5,238,631) also describes method to produce a twist tie in that relies on processing a thermoplastic composition with a core-rib design using a very specific processing methodology.

There exists a need for rigid, but conformable tie that is both metal-free and characterized by excellent mechanical properties, is formable as a unitary monolithic article formed from a single melt processing step, as opposed to a composite article formed by multiple steps. There is a need for a rigid, but conformable tie that does not require molding into a core-wing structure. The following disclosure describes articles having these desired characteristics, and compositions and methods for making such articles.

SUMMARY OF THE INVENTION

Unless defined otherwise, all technical and scientific terms used herein have the same meaning as commonly understood by one of ordinary skill in the art to which the invention pertains.

For purposes of the present invention, the following terms used in this application are defined as follows.

The articles "a" and "an" are used herein to refer to one or to more than one (i.e., to at least one) of the grammatical object of the article. By way of example, "an element" means one element or more than one element.

As used herein, the term "and/or" includes any and all combinations of one or more of the associated listed items.

"About" as used herein when referring to a measurable value such as an amount, a temporal duration, and the like, indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters.

"Amorphous" as applied to a thermoplastic polymer means a degree of crystallinity of not more than 20%, preferably not more than 15%, even more preferably not more than 10% and most preferably not more than 5% such as a degree of crystallinity determined by differential scanning calorimetry (DSC).

"Elastomer" or "elastomeric polymer" means a polymeric material that has a flexural modulus of less than 700 MPa according to ASTM D790 and a glass transition temperature less than 25° C.

By non-metallic is meant essentially free, preferably completely free, of metal or metallic compounds.

"Rigid" means a polymeric article that has a flexural modulus 1000 MPa.

Ranges: throughout this disclosure, various aspects of the invention can be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

Provided is a non-metallic tie comprising a polymeric material melt-blending from a composition comprising (a) from about 50 to about 80 wt % of at least one matrix-forming thermoplastic polymer which is amorphous or becomes amorphous when melted, and (b) from about 20 to about 50 wt % of at least one elastomeric polymer which has a flexural modulus of less than 700 MPa and a glass transition temperature less than 25° C., based on the combined weight of (a) and (b), wherein the tie is characterized by:

tensile elongation at break according to ASTM D638-00 of from about 20% to about 100%; and a dead fold angle equal to or less than about 30°, as determined by a method including the steps of (i) providing a sample of the tie having two end portions, a thickness of 1-2 mm and a length of 100 mm; (ii) folding the sample approximately in half in the lengthwise direction so that end portions are approximately adjacent to each other; (iii) relaxing the folded sample at room temperature for three minutes; and (iv) measuring as the dead fold angle the included angle between the article sample end portions.

In certain embodiments, the dead fold angle of the tie is equal to or less than about 20°.

In certain embodiments, the tie does not display visible cracking or breaking after 5 rounds of repeat bending in a test consisting of, as one round of bending, folding the tie so that end portions thereof are approximately adjacent to each other, followed by folding in the opposite direction.

In certain embodiments, the tie comprises from about 55 wt % to about 75 wt % of the at least one matrix-forming amorphous polymer, and from about 25 wt % to about 45 wt % of the at least one elastomeric polymer, based on the combined weight thereof. In certain embodiments, the tie comprises from about 55 wt % to about 70 wt % of the at least one matrix-forming amorphous polymer, and from about 30 wt % to about 45 wt % of the at least one elastomeric polymer, based on the combined weight thereof.

In certain embodiments of the tie, the at least one matrix-forming thermoplastic polymer which is amorphous or becomes amorphous when melted is selected from cycloolefin copolymers, polystyrene, polystyrene copolymers, polyacrylate, polymethacrylate, polyester, polylactic acid, polyvinylchloride, polyether imide, polyphenylene sulfide, polysulfone, polycarbonate, or combinations thereof.

In certain embodiments of the tie, the at least one elastomeric polymer is selected from cycloolefin copolymer elastomers, thermoplastic polyurethanes, polyolefin copolymer elastomers, acrylic copolymer elastomers, styrenic thermoplastic elastomers and acrylic core-shell elastomers.

In preferred embodiments, the matrix-forming amorphous polymer is a cycloolefin copolymer, a polylactic acid or a polycarbonate, and the elastomeric polymer is a cycloolefin copolymer elastomer, a thermoplastic polyurethane or a polybutyrate adipate terephthalate.

More preferably, the matrix-forming amorphous polymer is a polycyclic olefin copolymer or a polylactic acid, and the elastomeric polymer is a cycloolefin copolymer elastomer or a thermoplastic polyurethane.

In certain embodiments where the matrix-forming amorphous polymer is a cycloolefin copolymer, the cycloolefin comprises from about 50 wt % to about 70 wt % of the combination of the matrix-forming amorphous polymer and elastomeric polymer, and the elastomeric polymer is an elastomer cycloolefin copolymer comprising from about 50 wt % to about 35 wt % of the combination of the matrix-forming amorphous polymer and elastomeric polymer. In other embodiments where the matrix-forming amorphous polymer is a cycloolefin copolymer, the tie comprises about 60 wt % cycloolefin copolymer (amorphous) and about 40 wt % elastomer cycloolefin copolymer, based on the combination thereof.

In certain embodiments, at least the cycloolefin copolymer (amorphous) is an ethylene-norbornene copolymer. In some embodiments, both the cycloolefin copolymer (amorphous) and the elastomer cycloolefin copolymer are ethylene-norbornene copolymers.

In certain embodiments where the matrix-forming amorphous polymer is polylactic acid, the polylactic acid comprises from about 60 wt % to about 80 wt % of the combination of the matrix-forming amorphous polymer and elastomeric polymer. In other embodiments where the matrix-forming amorphous polymer is polylactic acid, the tie comprises from about 65 wt % to about 75 wt % of the combination of the matrix-forming amorphous polymer and elastomeric polymer. In other embodiments where the matrix-forming amorphous polymer is polylactic acid, the tie comprises about 70 wt % polylactic acid and about 30 wt % elastomeric polymer, based on the combination thereof. In certain embodiments in which the matrix-forming amorphous polymer is polylactic acid, the elastomeric polymer is a thermoplastic polyurethane.

According to certain embodiments, the tie has a uniform composition throughout.

In some embodiments, the tie has a uniform cross-section throughout its length.

In some embodiments, the tie is a twist-tie. In other embodiments, the tie is a tin-tie.

As envisioned in the present invention with respect to the disclosed compositions of matter and methods, in one aspect the embodiments of the invention comprise the components and/or steps disclosed herein. In another aspect, the embodiments of the invention consist essentially of the components and/or steps disclosed herein. In yet another aspect, the embodiments of the invention consist of the components and/or steps disclosed herein.

The above summary of the present invention is not intended to describe each disclosed embodiment or every implementation of the preset invention. The detailed description that follows more particularly exemplifies illustrative embodiments.

DETAILED DESCRIPTION OF THE INVENTION

Figure 1:
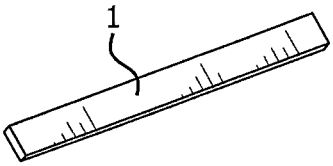
FIG. 1 is a perspective view of tie formed utilizing an embodiment of the invention.

Provided are non-metallic ties characterized by a simple construction that is easy to manufacture. The body of the tie is essentially free of metallic materials, e.g., it does not contain wires or other metallic structures. By "tie" is meant a generally elongated member typically in the shape of a filament or ribbon that functions as a closure for packaging, garments, face masks and the like. The tie in one embodiment operates by twisting of the ends of the member, and is thus a "twist-tie". In other embodiments, the tie operates by folding back the ends of the member on itself, and is a "tin-tie". Since the ties of the present invention are essentially free of metallic materials, the expression "tin-tie" as used herein means a member that has the shape, general characteristics and function of a tin-tie, but without a contained tin or other metallic member.

Unlike prior art composite twist-ties that rely on a core-wing construction where the core and wing are formed from different materials requiring multiple handling steps, the body of the tie of the present invention, in one embodiment, has a uniform composition throughout, formed from melt-blending a mixture of polymer precursors. The melt-blending step results in an article of uniform composition. The article may thus be readily manufactured on conventional extrusion or injection molding equipment by conventional techniques.

The tie is prepared from a composition by melt-blending a mixture comprising at least one matrix-forming thermoplastic polymer which is amorphous or becomes amorphous when melted, and at least one elastomeric polymer which has a flexural modulus of less than 700 MPa and a glass transition temperature less than 25° C. Herein, the expression "matrix-forming amorphous polymer" or "amorphous polymer" is utilized to refer to both matrix-forming thermoplastic polymers which are inherently amorphous, and matrix-forming thermoplastic polymers that become amorphous when melted.

"Melt-blending" is understood to mean a process where whereby polymers that are already formed are blended together in a molten state. Accordingly, polymer precursors may be dry-blended, e.g., in the form of a pellet mixture, followed by melting. "Melt-blending" is also understood to include simultaneously blending and melting of the polymer precursors, e.g., by co-extrusion. By "co-extrusion" is meant that the polymer precursors are extruded through a die at the same time. Melt blending may comprise, for example, any of the following processes: extrusion, injection molding, blow molding or rotomolding. Melt-blending is typically performed at a temperature from 80° to 300° C., although optimum operating temperatures are selected depending upon the melting point, melt viscosity, and thermal stability of the composition polymer components. Different types of melt processing equipment, such as extruders, may be used to process the melt processable compositions of this invention.

In certain embodiments, the melt-processable composition comprising the amorphous polymer and elastomeric polymer is profile-extruded into a continuous filament or other shape. In one embodiment, the filament is pulled faster than it is extruded or drawn. The diameter of the extrusion die to the diameter of the final profile is often referred to as the draw ratio. In one embodiment, it is desirable to have a draw ratio greater than 1:1. In another embodiment it is desirable to have a draw ratio greater than 2:1. The draw ratio generally should not exceed about 10:1. In a preferred embodiment, the extruded composition is first cooled, reheated and drawn inline. This is typically performed by reheating the extruded article to a temperature near or just above the glass transition temperature of the material. Those skilled in the art can select the proper types of equipment to draw polymeric profiles and films. Non-limiting examples include extrusion equipment that is properly equipped with godet and machine direction orienter equipment. Inline ovens can also be utilized to insure the extruded article is at the proper temperature when drawn. The resulting drawn articles have improved mechanical properties, including tensile strength that can be useful for twist tie applications.

The melt-blended composition is then cooled to form the ties, or sheets or other forms that are further molded or cut into the shape of a tie.

A melt-blended composition in the form of an extrudate may be cooled by well-known cooling methods, e.g., by extrusion into a water bath. Cooling is preferable carried out rapidly, in order to quench the polymer matrix to prevent excessive crystallization, which leads to loss of desirable functional characteristics. Accordingly, the extrudate is preferably cooled from its extrusion temperature (the temperature at which the extrudate leaves the die), at a rate of at least about 500° C./min., more preferably at least about 750° C./min., most preferably about 1000° C./min. Accordingly, the extrudate is preferably cooled in 20 seconds, preferably 15 seconds, more preferably 10 seconds. The cooling time should not exceed 30 seconds.

The melt-blended composition may be directly extruded as a ribbon or filament, or may be formed into sheets and cut into ties, particularly twist-ties. Alternatively, sheets may be formed and partially slit or perforated to allow for user manual separation of twist-ties from the sheet (also known as a "gang") of ties for applications such as trash bag ties. Alternatively, a ribbon or filament may be stored on reels such as those well known in the art for subsequent cutting into lengths appropriate for ties.

The length of the tie may vary according to application. In certain embodiments, the length may vary from about 1 cm to about 30 cm; from about 1 to about 10 cm; or from about 1 to about 9, 8, 7, 6, 5, 4, 3 or 2 cm. One preferred length is 9 cm. Other lengths are possible, depending on the application. The material of the tie may be provided in a roll of material which may be conveniently cut into shorter segments.

The cross-section of the tie, which is preferably uniform for the length of the article, may have any desired shape. The cross-section may comprise, for example, the following shapes: rectangle, square, circle, oval, half-moon, or any other geometric configuration. In one embodiment, the tie has a quadrilateral, preferably rectangular, cross-section.

The tie preferably has a width of from about 1 to about 10 mm, preferably from about 1 to about 9, 8, 7, 6, 5, 4, 3 or 2 mm. One preferred width is 3 mm. Other widths are possible, depending on the application.

The tie preferably has a thickness (where the cross-section is other than circular) of from about 0.1 to about 3 mm, preferably from about 0.3 to about 1 mm. Other preferred ranges include form about 0.3 to about 0.9, 0.8, or 0.7 mm. In preferred embodiments, the tie has a thickness of 0.6 mm.

In preferred embodiments, the tie has a rectangular cross-section and forms a ribbon having a thickness of from about 0.3 to about 0.9 mm, and a width of from about 1 to about 6 mm.

The tie is adapted to be deformed from an initial conformation in the form of a ribbon or filament of the indicated cross-section, to the conformation of releasable closure. As a twist-tie, the tie is able to undergo repeated closures by twisting and untwisting. As a tin-tie, the tie is able to undergo repeated closures by bending and unbending.

The at least one matrix-forming thermoplastic polymer which is amorphous, or becomes amorphous when melted, forms an amorphous thermoplastic polymer matrix upon melt-blending with the at least one elastomeric polymer. The amorphous thermoplastic polymer matrix which forms the tie is such that the article has enough stiffness to hold its shape after deformation. In one embodiment, the amorphous polymer matrix comprising the tie has a flexural modulus of at least 1000 MPa, in a preferred embodiment it has a flexural modulus of at least 1200 MPa, and in a most preferred embodiment, it has a flexural modulus of at least 1500 MPa, as determined by ASTM D790-07. The crystallinity of the matrix is controlled by judicious selection of the included elastomeric polymer. In one embodiment, the amorphous thermoplastic matrix constituting the body of the tie has a degree of crystallinity of not more than 15% in the extruded article. In a preferred embodiment the degree of crystallinity is not more than 10% and in a most preferred embodiment the degree of crystallinity is not more than 5%. The amorphous polymer matrix of the tie can inherently have low to no crystallinity or it can be derived from crystalline or semi-crystalline polymers that are melt processed in a way such that the melt-blended product is rapidly quenched prior to attainment of a significant level of crystallization. Thus, the matrix-forming thermoplastic polymer component may be itself amorphous, or may become amorphous when melt-blended with the elastomeric polymer. In the case of melt-blending by extrusion, quenching can be achieved by rapidly cooling the extrudate after it leaves the die of the extruder. Equivalent quenching techniques are employed for other forms of melt-blending.

Non-limiting examples of polymers useful as the matrix-forming amorphous polymer include, cycloolefin copolymers, polystyrene, polystyrene copolymers (e.g., high impact polystyrene and acrylonitrile butadiene styrene copolymer), polyacrylates, polymethacrylates, polyesters, polylactic acid, polyvinylchloride (PVC), polyether imides, polyphenylene sulfides, polysulfones, polycarbonates, or combinations thereof. In some embodiments, the matrix-forming amorphous polymer is a cycloolefin copolymer, a polylactic acid or a polycarbonate.

The expression "cycloolefin copolymer" refers to a copolymer prepared by addition copolymerization of acyclic olefin monomer and cycloolefin monomer. Specific cycloolefin monomers include, but are not limited to, those disclosed in U.S. Pat. No. 5,494,969 to Abe et al., cols. 9-27 and U.S. Pat. No. 9,452,593 to Tatarka et al., col. 10. One such preferred monomer is bicycle[2.2.1]hept-2-ene, also known as norborene. Preferred acyclic olefin monomers for copolymerization are ethylene, propylene, butylene and combinations thereof, with ethylene being most preferred. Preferred cycloolefin copolymers, as either the amorphous or elastomer polymer component of the tie material of the present invention, are ethylene-norbornene copolymers (CAS 26007-43-2).

A preferred amorphous polymer is polylactic acid (PLA), which those skilled in the art will understand is not a true acid but rather an aliphatic polyester, characterized by the moiety $[CH(CH_3)C(=O)O]_n$. The degree of PLA crystallinity is largely controlled by the ratio of D to L lactide enantiomers present in the polymerization mixture. The crystallinity of the polymerization product increases as the reactant molar ratio of L- and D-lactides departs from 1:1. Poly-DL-lactides that result from polymerization of a racemic mixture of L- and D-lactides are generally amorphous, and are thus preferred. It may be appreciated that while PLA is semi-crystalline, it crystallizes at a slow rate. Melt-blending with an elastomeric polymer prevents crystallization. Accordingly, PLA is an example of a polymer that becomes amorphous when melt-blended with an elastomer.

The elastomeric polymer for melt-blending with the amorphous polymer has a flexural modulus of less than 700 MPa according to ASTM D790 and a glass transition temperature of less than 25° C. The elastomeric polymer is preferably selected to have good compatibility with the amorphous polymeric matrix. The melt-processed article is preferably characterized by a morphology in which individual domains of either parent polymer are less than about 200 nm in size. The elastomer may be selected to result in a composition that has good optical clarity as a result of the compatibility. The addition of the elastomer to the rigid matrix formed by the matrix-forming amorphous polymer has the effect of toughening the resulting article. This effect can be quantified by examining the degree of elongation or necking after the article until breakage during a tensile test. In one embodiment, the degree of elongation of the article at break is greater than 20% but less than 100%, in a preferred embodiment it is greater than 30% but less than 90%.

Non-limiting examples of elastomers useful in the practice of the invention include: cycloolefin copolymer elastomers, thermoplastic polyurethanes, polyolefin copolymer elastomers, polybutyrate adipate terephthalate, acrylic copolymer elastomers, styrene based thermoplastic elastomers, such as block copolymers of styrene-butadiene-styrene, styrene-isoprene-styrene, styrene-ethylene/butylene-styrene and styrene-ethylene/propylene-styrene and core-shell elastomers as described in WO2012038441A1. Acrylic core/shell elastomers are elastomeric polymers comprise a shell of poly (alkyl acrylate or alkyl methacrylate) homo- or copolymer polymerized in the presence of at least an equal weight of a rubbery homo- or copolymer of an alkyl acrylate. They find use as impact modifiers. See, e.g., U.S. Pat. Nos. 3,985,703 and 8,816,008, describing the preparation of acrylic core/shell polymers.

In some embodiments, the elastomer is a cycloolefin copolymer elastomer, a thermoplastic polyurethane or a polybutyrate adipate terephthalate.

In preferred embodiments, the matrix-forming amorphous polymer is a cycloolefin copolymer, a polylactic acid or a polycarbonate, and the elastomer is a cycloolefin copolymer elastomer, a thermoplastic polyurethane or a polybutyrate adipate terephthalate.

In other preferred embodiments, the matrix-forming amorphous polymer is a cycloolefin copolymer or a polylactic acid, and the elastomer is a cycloolefin copolymer elastomer or a thermoplastic polyurethane. Preferred combinations thus include cycloolefin copolymer (amorphous)/cycloolefin copolymer elastomer, cycloolefin copolymer (amorphous)/thermoplastic polyurethane and polylactic acid/thermoplastic polyurethane.

Cycloolefin copolymers may have either an amorphous or elastomeric nature. Cycloolefin copolymer elastomers may be partially crystalline in nature, characterized by a crystallinity from 10% to 30%. Amorphous and elastomer cycloolefin copolymers, and blends thereof, are described by Tatarka et al, U.S. Pat. No. 9,452,593 and US Pat. Pub. 2012/0021151, the entire disclosures of which are incorporated herein by reference. Amorphous and elastomeric cycloolefin copolymers are available from Topas Advanced Polymers, Inc.

Preferred cycloolefin copolymers for either the amorphous polymer or elastomer polymer component of the present invention are ethylene-norbornene copolymers (CAS 26007-43-2). The characterization of amorphous versus elastomer (partially crystalline) ethylene-norbornene copolymer is a function of the relative amounts of monomer. Amorphous ethylene-norbornene copolymers are characterized by a higher norbornene content, from about 30 to about 70 mol %, while elastomer ethylene-norbornene copolymers are characterized by a lower norbornene content, from about 1 to about 20 mol %. Thus, according to certain embodiments, the composition for melt-blending into a tie comprises a blend of a first ethylene-norbornene copolymer having from about 30 to about 70 mol % norbornene content, and a second ethylene-norbornene copolymer having from about 1 to about 20 mol % norbornene content.

A preferred amorphous ethylene-norbornene copolymer for the practice of the present invention is the material sold by Topas Advanced Polymers, Inc. as TOPAS®8007S-04 Cyclic Olefin Copolymer, which has a norbornene content of about 36 mol %. A preferred elastomer ethylene-norbornene copolymer is the material sold by Topas Advanced Polymers, Inc. as TOPAS® Elastomer E-140, which has a norbornene content of about 8-9 mol %. The properties of TOPAS® Elastomer E-140 are described in Table 2 and col. 13 of Tatarka et al, U.S. Pat. No. 9,452,593.

Thermoplastic polyurethanes (TPUs) for use as the elastomer include all forms of polyurethanes, i.e., polyester, polyether and polycaprolactone TPUs, inclusive of both aromatic and aliphatic varieties. Preferred TPUs are polyester and polyether TPUs.

The proportions of the matrix-forming amorphous polymer and elastomeric polymer that are melt-blended generally range from about 50 wt % to about 80 wt % of (a) the at least one matrix-forming amorphous polymer, and from about 20 wt % to about 50 wt % of (b) the at least one elastomeric polymer, based on the combination thereof. In certain embodiments, the range is: from about 55 wt % to about 75 wt % of (a) and from about 25 wt % to about 45 wt % of (b); from about 55 wt % to about 70 wt % of (a) and from about 30 wt % to about 45 wt % of (b); from about 55 wt % to about 65 wt % of (a) and from about 35 wt % to about 45 wt % of (b); or from about 55 wt % to about 60 wt % of (a) and from about 40 wt % to about 45 wt % of (b).

The actual amounts of amorphous polymer and elastomeric polymer may be selected from the above ranges depending on the nature of the specific matrix-forming amorphous polymer and elastomeric polymer. For example, when the amorphous polymer is a cyclic olefin copolymer (COC), the mixture generally preferably comprises from about 50 wt % to about 70 wt % amorphous COC, and from about 30 wt % to about 50 wt % elastomeric polymer, the latter preferably being an elastomer COC or a TPU; more preferably from about 50 wt % to about 60 wt % amorphous COC, and from about 40 wt % to about 50 wt % elastomeric polymer, the latter preferably being an elastomer COC or a TPU.

In preferred embodiments of the present invention where the polymers of the composition for melt-blending are comprised entirely of COCs, the composition comprises from about 50 to about 65 wt % amorphous COC and from about 35 to about 50 wt % elastomer COC; more preferably from about 55 to about 65 wt % amorphous COC and from about 35 to about 45 wt % elastomer COC; most preferably about 60 wt % amorphous COC and about 40% wt % elastomer COC. In preferred embodiments, where the amorphous and elastomeric polymers are both COCs, the COCs are ethylene-norbornene copolymers.

When the matrix-forming amorphous polymer is polylactic acid, the mixture preferably comprises from about 60 wt % to about 80 wt % polylactic acid, and from about 20 wt % to about 40 wt. % elastomeric polymer, the latter preferably being an elastomer COC or a TPU. More preferably, the mixture comprises from about 65 wt % to about 75 wt % polylactic acid, and from about 25 wt % to about 35 wt. % elastomeric polymer, the latter preferably being an elastomer COC or a TPU.

In another embodiment, the melt processable composition comprising the matrix-forming amorphous polymer and the elastomeric polymer may contain other reinforcing fillers to tailor the mechanical properties of the non-metallic tie. The fillers and fibers may be incorporated into the melt processable composition in the form of powders, pellets, granules or any other extrudable form. The amount and type of fillers in the melt processable composition may vary depending on the polymeric matrix and desired physical properties. Those skilled in the art of melt processing are capable of selecting appropriate amounts and types of fillers to match the specific polymeric matrix in order to achieve the desired physical properties in the finished material. Non-limiting examples of fillers useful in this invention include: silicates, aluminosilicates, talc, mica, wollastonite, carbon fiber, glass fiber, glass microspheres, hollow glass microspheres, cellulosic fibers and fillers.

The melt processable composition comprising the matrix-forming amorphous polymer and the elastomeric polymer may contain other additives to provide certain functionality. Non-limiting examples of conventional additives include antioxidants, light stabilizers, blowing agents, foaming additives, antiblocking agents, heat stabilizers, impact modifiers, biocides, antimicrobial additives, compatibilizers, plasticizers, tackifiers, processing aids, lubricants, coupling agents, flame retardants, colored streakers. The additives may be incorporated into the melt processable composition in the form of powders, pellets, granules, or in any other extrudable form. The amount and type of conventional additives in the melt processable composition may vary depending upon the polymeric matrix and the desired physical properties of the finished composition. Those skilled in the art of melt processing are capable of selecting appropriate amounts and types of additives to match with a specific polymeric matrix in order to achieve desired physical properties of the finished material.

The ties according to the present invention are characterized by a unique set of properties. In certain embodiments, the articles have an outstanding toughness, characterized by an elongation at break greater than 20% but less than 100%. The tie articles also have excellent twist holding capability and when employed as twist-ties can be used multiple times. In certain embodiments, the tie maintains integrity after 5 uses, in a preferred embodiment, the tie maintains integrity after 10 uses, in a most preferred embodiment, the tie maintains integrity after 20 uses. Most significantly, the ties of the present invention are characterized by a dead-fold angle of less than or equal to about 30°. In certain embodiments, the dead fold angle is less than or equal to about 25°, 24°, 23°, 22°, 21°, 20°, 19°, 18°, 17°, 16°, 15°, 14°, 13°, 12°, 11° or 10°.

In certain embodiments, the peak stress of the, as determined by a non-traditional tensile test measurement described in the Examples that follow, is greater than 2000 psi, and preferably greater than 4000 psi.

Figure 2:
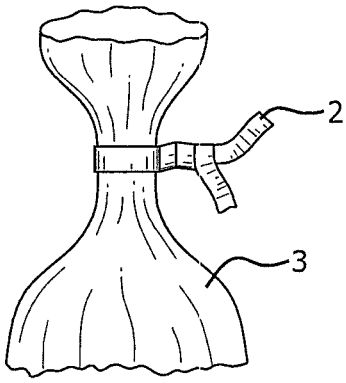
FIG. 2 is a front view of a twist-tie according to an embodiment of the invention in place on a bag.

An embodiment of a tie 1 according to the invention is shown in FIG. 1. The tie may be utilized, for example, to reversibly seal bags and other packaging, including but not limited to polyethylene bags such as bread bags, and other packaging. The operation as a twist-tie 2 according to an embodiment of the invention sealing a bag 3 is shown in FIG. 2. To seal the bag, the packaging material adjacent the open end is gathered; the twist-tie is wrapped around the gathered package end until the twist tie end portions are adjacent each other. The twist-tie end portions are twisted to fasten the tie on the package.

Figure 5:
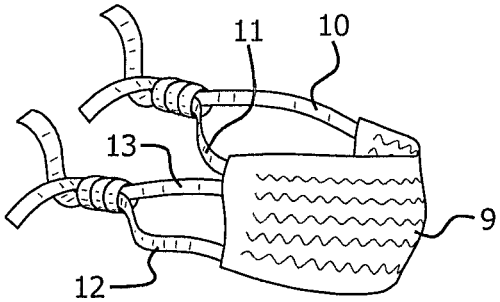
FIG. 5 is a perspective view of a surgical mask with attached twist-tie pairs according to an embodiment of the invention.

The ties may also be affixed in pairs to various articles such as garments, hospital gowns, disposable facemasks, such as surgical masks, and the like to act as closures or, in the case of a facemask, a means to secure the mask in position on a wearer's face. FIG. 5 illustrates a surgical mask 9 with two attached pairs of twist-ties 10, 11 and 12, 13.

Figure 3:
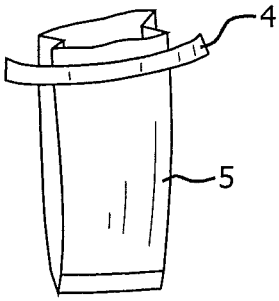
FIG. 3 is a perspective view of a tin-tie according to an embodiment of the invention attached to a bag.
Figure 4:
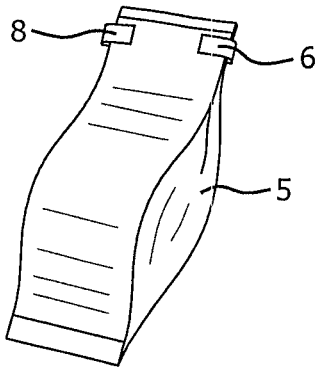
FIG. 4 is a rear perspective view of the back of the bag shown in FIG. 3 after folding the ends of the tin-tie to close the bag opening.

In operation as a tin-tie, the tie is positioned (or previously affixed to) the portion of a packaging material near the open end. FIG. 3. is a representation of a bag 5 having an affixed tin-tie 4. The ends of the tin-tie 4 are bent 180° back onto the body of the tin-tie, capturing the packaging material in the folded tie to effect closure of the package. FIG. 4 is a view of the back of bag 5 showing folded-over tin-tie ends 6 and 8.

The practice of the invention is illustrated by the following non-limiting examples. The skilled person skilled in the art will appreciate that it may be necessary to vary the procedures for any given embodiment of the invention.

EXAMPLES

The materials listed in Table 1 where utilized to prepare the compositions of Table 2 that were melt-processed into twist-ties according to the conditions set forth under "SAMPLE PREPARATION". The proportions of Table 2 are weight percent values, based on the combined weight of amorphous polymer and elastomer blended. Examples CE5-CE8 represent comparative examples of high dead fold angle. While Examples CE1-CE4 where characterized by dead fold angles of about 20°, the samples performed poorly upon bend test, withstanding only a single round of bending before cracking or breaking.

TABLE 1

| Material | Polymer type | Supplier |
|---|---|---|
| COC1 (cycloolefin copolymer) | amorphous polymer | Topas -8007S-04 |
| COC2 (cycloolefin copolymer) | amorphous polymer | Topas - E140 |
| PLA (polylactic acid) | amorphous polymer | Nature Works -Ingeo 2003D |
| PC (polycarbonate) | amorphous polymer | Covestro -Makrolon ® 2558 |
| TPU1 (thermoplastic polyurethane) | elastomer | BASF -Elastollan ® C78A10 |
| TPU2 (thermoplastic polyurethane) | elastomer | BASF -Elastollan ® Soft Soft 35A 12P |
| TPU3 (thermoplastic polyurethane) | elastomer | BASF -Elastollan ® 45A12P |
| TPU4 (thermoplastic polyurethane) | elastomer | Huntsman-IROGRAN ® TPU A92P4637 |
| TPU5 (thermoplastic polyurethane) | elastomer | BASF - Elastollan ® 1185A10 Nat |
| PBAT (polybutyrate adipate terephthalate) | elastomer | BASF- Ecoflex F Blend C1200 |

TABLE 2

| Example | COC1 | PLA | PC | COC2 | TPU1 | TPU2 | TPU3 | TPU4 | TPU5 | PBAT |
|---|---|---|---|---|---|---|---|---|---|---|
| CE1 | 100 | | | | | | | | | |
| CE2 | 90 | | | 10 | | | | | | |
| CE3 | 80 | | | 20 | | | | | | |
| CE4 | 70 | | | 30 | | | | | | |
| CE5 | 40 | | | 60 | | | | | | |
| CE6 | 30 | | | 70 | | | | | | |
| CE7 | 20 | | | 80 | | | | | | |
| CE8 | 10 | | | 90 | | | | | | |
| 1 | 60 | | | 40 | | | | | | |
| 2 | 50 | | | 50 | | | | | | |
| 3 | 70 | | | | 30 | | | | | |
| 4 | 65 | | | | 35 | | | | | |
| 5 | 60 | | | | 40 | | | | | |
| 6 | 55 | | | | 45 | | | | | |
| 7 | | 55 | | | 45 | | | | | |
| 8 | | 60 | | | 40 | | | | | |
| 9 | | 65 | | | 35 | | | | | |
| 10 | | | 70 | | 30 | | | | | |
| 11 | | | 65 | | 35 | | | | | |
| 12 | | | 60 | | 40 | | | | | |
| 13 | 60 | | | | | | | | | 40 |
| 14 | | 70 | | | | | | | | 30 |
| 15 | | 75 | | | | 25 | | | | |
| 16 | | 70 | | | | 30 | | | | |
| 17 | | 65 | | | | 35 | | | | |

TABLE 2-continued

| Example | COC1 | PLA | PC | COC2 | TPU1 | TPU2 | TPU3 | TPU4 | TPU5 | PBAT |
|---|---|---|---|---|---|---|---|---|---|---|
| 18 | | 60 | | | | 40 | | | | |
| 19 | | 75 | | | | | 25 | | | |
| 20 | | 70 | | | | | 30 | | | |
| 21 | | 65 | | | | | 35 | | | |
| 22 | | 60 | | | | | 40 | | | |
| 23 | | 55 | | | | | 45 | | | |
| 24 | | 75 | | | | | | 25 | | |
| 25 | | 70 | | | | | | 30 | | |
| 26 | | 65 | | | | | | 35 | | |
| 27 | | 60 | | | | | | 40 | | |
| 28 | | 55 | | | | | | 45 | | |
| 29 | | 70 | | | | | | | 30 | |
| 30 | | 65 | | | | | | | 35 | |
| 31 | | 60 | | | | | | | 40 | |
| 32 | | 70 | | | | | | | 30 | |
| 33 | | 70 | | | | 30 | | | | |
| 34 | | 70 | | | | 30 | | | | |
| 35 | | 70 | | | | 30 | | | | |

Sample Preparation

Matrix-forming amorphous polymer (COC1, PLA, PC) and elastomer (COC2, TPU, PBAT) were dry blended in a plastic bag and gravimetrically fed into a 11 mm twin screw extruder (commercially available from Thermo Scientific, 40:1 L:D). For examples CE1-CE8 and 1-6, compounding was performed at a 235° C. temperature profile for zones 1-10 with the die temperature of 200° C. at 160 rpm screw speed and 14 g/min output. For examples 7-9, the compounding was performed at a 210° C. temperature profile for zones 1-10 with the die temperature of 160° C. at 160 rpm screw speed and 14 g/min output. For examples 10-12, the compounding was performed at a 220° C. temperature profile for zones 1-10 with the die temperature of 200° C. at 160 rpm screw speed and 14 g/min output. For example 13, the compounding was performed at a 200° C. temperature profile for zones 1-10 with the die temperature of 180° C. at 160 rpm screw speed and 14 g/min output. For example 14, the compounding was performed at a 200° C. temperature profile for zones 1-10 with the die temperature of 180° C. at 160 rpm screw speed and 14 g/min output. For examples 15-18, the compounding was performed at a 210° C. temperature profile for zones 1-10 with the die temperature of 140° C. at 160 rpm screw speed and 14 g/min output. For examples 19-23, the compounding was performed at a 210° C. temperature profile for zones 1-10 with the die temperature of 140° C. at 160 rpm screw speed and 14 g/min output. For examples 24-28, the compounding was performed at a 220° C. temperature profile for zones 1-10 with the die temperature of 200° C. at 160 rpm screw speed and 14 g/min output. For examples 29-31, the compounding was performed at a 220° C. temperature profile for zones 1-10 with the die temperature of 170° C. at 160 rpm screw speed and 14 g/min output. The compounds were extruded into strands approximately 1.5 mm width and 250 cm in length. The compounds were extruded through a 2.5 mm round orifice dies and quenched in a water bath at temperature of from about 20° C. to about 35° C. The resulting samples were tested for dead fold performance; twist performance and bend repeat performance using the following test methods.

Procedure for Producing Machine Direction Oriented Film, Example 32

An ~0.035" thick film was produced by single screw film extrusion of these previously blended compounded pellets of formulation 29. The extruder temps were 350° F. in zone 1 and 375° F. in the remaining zones. The die temperature was also 375° F. The extruded material was first cast onto a chrome chill roll cooled to 100° F. in a three-roll stack configuration. The line speed was 15 ft/min prior to orientation. The film was subsequently heated inline to 250° F. and oriented or drawn 100-150% of its original length using a Machine Direction Orienter (MDO) to produce a film of ~0.014" thickness. Three replicate samples of the prepared MDO film was analyzed by differential scanning calorimetry (DSC, Netzsch DCS/TGA model STA 449 F3, Netzsch Group, Selb, Germany. The specimens were heated in air from 25° C. to 200° C. at a rate of 5° C./min. The melting transitions and % crystallinity of the resulting film is provided in Table 4.

Procedure for Producing Machine Direction Oriented Filament, Examples 33-35

A filament was produced by single screw film extrusion of these previously blended compounded pellets of formulation 16. The extruder temperatures were 60° C. in zone 1, 150° C. in zone 2, and 210° C. in the remaining zones. The die temperature was at 170° C. The material was extruded through a 1.75 mm strand die into a water bath at 60° C. and then into a Machine Direction Orienter (MDO) with a roll temperature of 70-75° C. The 3 filament examples 33-35 were prepared by drawing the incoming filament at 100%, 200%, and 300% in the MDO. For 100% the MDO was run at 3.7 to 7.4 m/min to provide a filament of 1.352 mm in diameter, 200% was run at 3.7 to 11.1 m/min to provide a filament of 1.053 mm in diameter, and for 300% the MDO was run at 3.7 to 13 m/min to provide a filament of 1.028 mm in diameter. The three examples of the prepared MDO filament were analyzed by differential scanning calorimetry (DSC, Netzsch DCS/TGA model STA 449 F3, Netzsch Group, Selb, Germany. The samples were heated in air from 25° C. to 200° C. at a rate of 5° C./min. The melting transitions and % crystallinity of the resulting filaments is provided in Table 4.

The following procedure was followed to prepare samples for mechanical testing purposes. Flexural and tensile specimens were injection molded per ASTM D790 and ASTM D368 using an Arburg 270C Allrounder injection molder. The conditions for molding were as follows. For examples 1-10, the barrel temperature was 530° F., a mold temperature of 100° F. and an injection speed of 0.5 in/s. For examples 11-13, the barrel temperature was 450° F., a mold temperature of 158° F. and an injection speed of 0.5 in/s. For examples 15-17, the barrel temperature was 450° F., a mold temperature of 110° F. and an injection speed of 0.5 in/s. For examples 18-20, the barrel temperature was 490° F., a mold temperature of 180° F. and an injection speed of 0.5 in/s. For examples 23-36, the barrel temperature was 450° F., a mold temperature of 110° F. and an injection speed of 0.5 in/s. Samples 6, 13 and 14 were unable to be properly injection molded and were therefore tensile properties were not characterized.

Test Methods

The samples were subjected to the following test methods. All test methods are derived from test methods for twist ties defined in Feltman, U.S. Pat. No. 5,827,461.

Dead-Fold Angle Test.

The dead fold angle test measures the degree of memory a blend exhibits when it is folded 180 degrees. The term "memory" means the ability of the polymeric twist tie to remain in a position when the polymeric twist tie is formed into the position. In this test, a sample is folded approximately in half so that the end portions of the polymeric twist tie are approximately adjacent to each other. After relaxing for three minutes at room temperature, the angle of relaxation is obtained by measuring an included angle between the end portions. The polymeric twist ties of the present invention exhibit a dead fold angle of less than 30° and preferably less than or equal to 20°.

Repeat Bend Test.

The repeat bend test determines how many times a polymeric twist tie can survive an alternating 180° fold. The alternating 180° fold is an especially important characteristic when the polymeric twist tie is used as a replacement for a tin tie. For this test, a sample of the polymeric twist tie is folded until end portions of the polymeric twist tie are approximately adjacent to each other, for one bend. Then, the polymeric twist tie sample is folded in the opposite direction, for a second bend. The alternating bend test is repeated ten times. It is believed that ten alternating folds is greater than what would be expected under typical use conditions. The repeat bend test does not cause breaking or cracking of the polymeric twist ties of the present invention.

Twist Tie Tensile Test.

This non-traditional tensile test examines an ability of a polymeric twist-tie to resist breakage when it is tied around two pins that are forced apart. This test also examines the ability of the polymeric twist tie to remain tied when the pins are forced apart. This test is performed using a MTS Criterion Model 43 Universal Mechanical Testing Machine manufactured by MTS Systems Corporation of Eden Prairie, Minn., USA. The pins are mounted in the Advantage Wedge Action Grips (Assembly No: 54-951-001) for movement relative to each other. The polymeric twist tie is placed around the pins so that the polymeric twist tie encircles the pins. End portions of the polymeric twist tie are then twisted three complete revolutions, with the twisted portions positioned perpendicular to the tensile motion, to fasten the twist tie around the pins. The pins are then pulled apart and the force needed to break the twist tie or the twist is measured. The average peak stress in pounds force per square inch (psi) was recorded.

Tensile Test.

The tensile property of percent elongation at break was determined according to ASTM D638-00. The test was performed using Criterion Model 43 Universal Mechanical Testing Machine manufactured by MTS Systems Corporation of Eden Prairie, Minn., USA. The percent elongation at breakage was recorded.

TABLE 3

Mechanical Property Testing Results

| Example | Dead-fold Angle Test (°) | Repeat Bend Test (number of bends) | Twist Tie Tensile Test (average peak stress, psi) | Tensile Test (elongation at break, %) |
|---|---|---|---|---|
| CE1 | 20 | 1 | 4593 | 14 |
| CE2 | 20 | 1 | 5326 | 22 |
| CE3 | 20 | 1 | 4152 | 35 |
| CE4 | 19 | 1 | 3214 | 72 |
| CE5 | 53 | >10 | 445 | 249 |
| CE6 | 67 | >10 | 272 | 295 |
| CE7 | 69 | >10 | 255 | 0 |
| CE8 | 95 | >10 | 229 | 306 |
| 1 | 19 | 8 | 4712 | 76 |
| 2 | 19 | >10 | 3422 | 414 |
| 3 | 13 | 2 | 3715 | 7 |
| 4 | 12 | 5 | 5227 | 6 |
| 5 | 14 | 3 | 3714 | 6 |
| 6 | 19 | 3 | 3853 | Not Tested |
| 7 | 15 | 4 | 2863 | 31 |
| 8 | 14 | 3 | 2617 | 58 |
| 9 | 19 | 2 | 3334 | 49 |
| 10 | 29 | 6 | 3016 | 5 |
| 11 | 30 | >10 | 673 | 64 |
| 12 | 20 | 1 | 2368 | 69 |
| 13 | 14 | 3 | 2230 | Not Tested |
| 14 | 5 | 4 | 3672 | Not Tested |
| 15 | 17 | 9 | 2847 | 35 |
| 16 | 16 | >10 | 3158 | 40 |
| 17 | 17 | >10 | 2959 | 81 |
| 18 | 12 | >10 | 1610 | 88 |
| 19 | 12 | 3 | 2788 | 30 |
| 20 | 12 | 6 | 2332 | 50 |
| 21 | 13 | >10 | 7446 | 55 |
| 22 | 29 | >10 | 2357 | 60 |
| 23 | 83 | >10 | 2144 | 88 |
| 24 | 18 | 1 | 3148 | 15 |
| 25 | 16 | 1 | 3360 | 32 |
| 26 | 18 | 3 | 3443 | 53 |
| 27 | 19 | 5 | 3420 | 74 |
| 28 | 19 | >10 | Not Tested | 84 |
| 29 | 7 | >10 | 4445 | 42 |
| 30 | 6 | >10 | 4691 | Not Tested |
| 31 | 5 | >10 | 4627 | Not Tested |
| 32 | NA | >10 | 11890 | 62 |
| 33 | 18 | >10 | 5824 | 29 |
| 34 | 17 | >10 | 5431 | 6 |
| 35 | 19 | >10 | 6320 | 8 |

TABLE 4

Differential Scanning Calorimetry Results

| Sample | Melting Peak Temperature (° C.) | Crystallinity (%) |
|---|---|---|
| 32 | 148 | 5.4 |
| 33 | 148 | 6.2 |
| 34 | 147 | 11.6 |
| 35 | 146 | 19.9 |

All references disclosed herein are incorporated by reference. Although specific embodiments have been illustrated and described herein for purposes of description of the preferred embodiments, it will be appreciated by those of ordinary skill in the art that a wide variety of alternate or equivalent implementations calculated to achieve the same purposes may be substituted for the specific embodiments shown and described without departing from the scope of the present invention. This application is intended to cover any adaptations or variations of the preferred embodiments discussed herein. Therefore, it is manifestly intended that this invention be limited only by the claims and the equivalents thereof.

What is claimed is:

1. A non-metallic tie comprising a polymeric material melt-blending from a composition comprising (a) from about 50 to about 75 wt % of at least one matrix-forming thermoplastic polymer which is amorphous or becomes amorphous when melted, and (b) from about 25 to about 50 wt % of at least one elastomeric polymer which has a flexural modulus of less than 700 MPa and a glass transition temperature less than 25° C., based on the combined weight of (a) and (b), wherein the tie is characterized by:

tensile elongation at break according to ASTM D638-00 of from about 20% to about 100%; and a dead fold angle equal to or less than about 30°, as determined by a method including the steps of (i) providing a sample of the twist tie having two end portions, a thickness of 1-2 mm and a length of about 100 mm; (ii) folding the sample approximately in half in the lengthwise direction so that end portions are approximately adjacent to each other; (iii) relaxing the folded sample at room temperature for three minutes; and (iv) measuring as the dead fold angle the included angle between the article sample end portions, wherein the matrix-forming amorphous polymer is a cycloolefin copolymer, a polylactic acid or a polycarbonate, and the elastomeric polymer is a cycloolefin copolymer elastomer, a thermoplastic polyurethane or a polybutyrate adipate terephthalate and wherein the tie is not a core-wing structure.

2. The tie according to claim 1, wherein the matrix-forming amorphous polymer has a degree crystallinity of not more than 15% determined by differential scanning calorimetry.

3. The tie according to claim 2, wherein the dead fold angle is equal to or less than about 20°.

4. The tie according to claim 2, which does not display visible cracking or breaking after 5 rounds of repeat bending in a test consisting of, as one round of bending, folding the tie so that end portions thereof are approximately adjacent to each other, followed by folding in the opposite direction.

5. The tie according to claim 4, which does not display visible cracking or breaking after 10 rounds of repeat bending.

6. The tie according to claim 2, comprising from about 55 wt % to about 75 wt % of the at least one matrix-forming amorphous polymer, and from about 25 wt % to about 45 wt % of the at least one elastomeric polymer, based on the combined weight thereof.

7. The tie according to claim 2, comprising from about 55 wt % to about 70 wt % of the at least one matrix-forming amorphous polymer, and from about 30 wt % to about 45 wt % of the at least one elastomeric polymer, based on the combined weight thereof.

8. The tie according to claim 1, wherein the matrix-forming amorphous polymer is a polycyclic olefin copolymer or a polylactic acid, and the elastomeric polymer is a cycloolefin copolymer elastomer or a thermoplastic polyurethane.

9. The tie according to claim 8, wherein the matrix-forming amorphous polymer is a cycloolefin copolymer, and comprises from about 50 wt % to about 70 wt % of the combination of the matrix-forming amorphous polymer and elastomeric polymer.

10. The tie according to claim 9, wherein the matrix-forming amorphous polymer is a cycloolefin copolymer, and comprises from about 50 wt % to about 65 wt % of the combination of the matrix-forming amorphous polymer and elastomeric polymer, and the elastomeric polymer is an elastomer cycloolefin copolymer comprising from about 50 wt % to about 35 wt % of the combination of the matrix-forming amorphous polymer and elastomeric polymer.

11. The tie according to claim 10, comprising about 60 wt % cycloolefin copolymer and about 40 wt % elastomer cycloolefin copolymer, based on the combination thereof.

12. The tie according to claim 9, wherein the cycloolefin copolymers are ethylene-norbornene copolymers.

13. The tie according to claim 8, wherein the matrix-forming amorphous polymer is polylactic acid, and comprises from about 60 wt % to about 75 wt % of the combination of the matrix-forming amorphous polymer and elastomeric polymer.

14. The tie according to claim 13, wherein the matrix-forming amorphous polymer is polylactic acid, and comprises from about 65 wt % to about 75 wt % of the combination of the matrix-forming amorphous polymer and elastomeric polymer.

15. The tie according to claim 14, wherein the matrix-forming amorphous polymer comprises about 70 wt % of the combination of the matrix-forming amorphous polymer and elastomeric polymer.

16. The tie according to claim 13, wherein the elastomeric polymer is a thermoplastic polyurethane.

17. The tie according to claim 2, having a uniform composition throughout.

18. The tie according to claim 2, having a uniform cross-section throughout the length thereof.

19. The tie according to claim 2, wherein the tie is a twist-tie.

20. The tie according to claim 1, wherein the matrix-forming amorphous polymer has a degree crystallinity of not more than 10% determined by differential scanning calorimetry.

21. The tie according to claim 1, wherein the matrix-forming amorphous polymer has a degree crystallinity of not more than 5% determined by differential scanning calorimetry.

* * * * *